US011857005B1

(12) United States Patent
Rahman

(10) Patent No.: US 11,857,005 B1
(45) Date of Patent: Jan. 2, 2024

(54) HYBRID PERSONAL COOLING AND HEATING SYSTEM

(71) Applicant: M Arifur Rahman, Honolulu, HI (US)

(72) Inventor: M Arifur Rahman, Honolulu, HI (US)

( * ) Notice: Subject to any disclaimer, the term of this patent is extended or adjusted under 35 U.S.C. 154(b) by 70 days.

(21) Appl. No.: 17/139,861

(22) Filed: Dec. 31, 2020

Related U.S. Application Data

(60) Provisional application No. 63/029,394, filed on May 22, 2020.

(51) Int. Cl.
*A41D 13/005* (2006.01)
*F28D 20/00* (2006.01)

(52) U.S. Cl.
CPC ..... *A41D 13/0051* (2013.01); *A41D 13/0053* (2013.01); *F28D 20/0034* (2013.01); *F28D 2020/0047* (2013.01)

(58) Field of Classification Search
CPC .. F24F 11/89; A41D 13/0053; F28D 20/0034; F28D 2020/0047
See application file for complete search history.

(56) References Cited

U.S. PATENT DOCUMENTS 6,019,165 A * 2/2000 Batchelder ..... H01L 23/467 165/80.4
6,936,791 B1 * 8/2005 Baldwin ..... H05B 3/00 219/521
9,867,405 B1 * 1/2018 McFerrin ..... A41D 13/0053
2004/0007553 A1 * 1/2004 Smolko ..... F25D 7/00 215/12.1
2006/0157858 A1 * 7/2006 Furman ..... H01L 23/473 257/E23.098
2014/0312077 A1 * 10/2014 Tajima ..... A47J 41/0022 222/552
2015/0173445 A1 * 6/2015 Gordon ..... A42B 3/285 62/3.3
2015/0219358 A1 * 8/2015 Alfakhrany ..... F24F 7/06 454/366

FOREIGN PATENT DOCUMENTS

CN 109110507 A * 1/2019 ..... B65G 54/02
WO WO-2019054120 A1 * 3/2019 ..... F24D 11/0207

OTHER PUBLICATIONS

Translation of CN-109110507-A (Year: 2019).*
WO-2019054120-A1 Translation (Year: 2019).*

* cited by examiner

*Primary Examiner* — Schyler S Sanks
(74) *Attorney, Agent, or Firm* — Plager Schack LLP; Mark H. Plager; Michael J. O'Brien

(57) ABSTRACT

A fully adjustable hybrid personal cooling and heating system is configured to remove or supply heat from/to a human user. The system is specifically designed to provide up to 8-hours of high efficiency adjustable cooling or heating when worn and operated by a user. The personal cooling and heating system use non-toxic room-temperature liquid metal as primary coolant and phase-change material as secondary coolant. The primary coolant is pumped using an active powered pump which absorbs heat from the user's body, and passively release the heat to the secondary coolant making the invention a hybrid cooling/heating system. Passive heat release is facilitated by extreme high thermal conductivity of the primary coolant. Also, the secondary coolant is thermally insulated from the environment allowing on-demand heat absorption only from the primary coolant.

10 Claims, 4 Drawing Sheets

HYBRID PERSONAL COOLING AND HEATING SYSTEM

RELATED APPLICATION

This application claims priority to provisional patent application U.S. Ser. No. 63/029,394 filed on May 22, 2020, the entire contents of which is herein incorporated by reference.

BACKGROUND

The embodiments herein relate generally to cooling or heating wearables.

Prior to embodiments of the disclosed invention, high stress is health risk for many workers working indoor and outdoor in extreme heat environments. Employees and employers are losing trillions of dollars of wage-hours due to unworkable high heat environments. Also, thousands of employees die each year due to heat stroke every year globally.

As such, there apparently still exists the need for new and improved personal cooling and heating system to maximize the benefits to the user at an affordable cost for the target customer, and minimize the risks of injury from its use. In this respect, the present invention disclosed herein substantially corrects these problems, fulfills the need for such a device, and present an innovative, and new system.

SUMMARY

Previously, there was no adequate device in heat stress and cold weather exposure relief systems for individuals, such as industry workers, and first responders who are operating in hot and cold environments for extended periods of time. Desert conditions and extreme hot or cold work environment such as shipyard, mines, arctic regions etc., often placed individuals in a heat stress environment during the daylight hours and in severe cold during the nighttime. Heat stress could result in sweating, fatigue, dehydration, dizziness, hot skin temperature, muscle weakness, increased heart rate, heat rash, fainting, injuries, weight loss, heat stroke, heat exhaustion, and even death. The risk of heat stress was even greater for those wearing nuclear, biological and chemical (NBC) protective clothing, as well as aircrew personnel wearing flight gear. Cold weather exposure can cause discomfort; pain; numbness; cardiac, circulatory and respiratory problems; diminished muscle function and performance; frostbite, and hypothermia which can lead to unconsciousness and death.

Although a portable, lightweight, low power, highly efficient, personal cooling and heating system could reduce heat stress, reduce the adverse effects of cold exposure, improve performance, and reduce water consumption, current active and passive cooling systems fall short of meeting the minimum requirements for an optimal system, i.e. 50 Watts of cooling for over 7 hour.

Active personal cooling devices and active personal heating systems are well known in the prior art. However, the prior and current active cooling and heating systems, are too heavy for longer use, bulky, inefficient, and are effective for only a limited amount of time. These devices also consume too much power and use potentially dangerous materials such as refrigerant. Passive cooling and heating systems use packets containing phase change chemicals, water or gel that cannot provide on-demand cooling/heating. Also, current passive cooling/heating system performance significantly affected by the environmental condition. Other endeavors in this field include:

U.S. Army PICS (Personal Ice-Cooling System) Problem: This system uses packed ice. The ice must be changed every 30 minutes. The system cannot preserve cooling once outside the freezer for on demand cooling.

U.S. Army PVCS (Portable Vapor Compression Cooling System) Problems: The total system is much too heavy (27 pounds); can't use vapor compression on non-level surfaces such as ships; compressed containers can rupture in high temperatures, exposure to liquid or vapor refrigerant can cause frostbite, high exposure to fumes can cause central nervous system depression, irregular heartbeat and suffocation.

U.S. Army ALMCs (Advanced Lightweight Microclimate Cooling System) Problems: The system uses vapor compression cycle cooling. The cooling system is heavy, consumes large power in mobile use, hence able to provide cooling for max 2 hours in untethered mood while designed with a carriable weight.

IMCC (Integrated Mesoscopic Cooling Circuits) (DARPA) Problem: Insufficient cooling.

NASA and U.S. Air Force (APECS) Aircrew Personal Environmental Control System Problem: This system is too bulky for infantry soldiers.

Life Enhancement Technologies Problem: The ice water mixture for the cooling unit must be replenished. Also, coolants in any of the existing system cannot be recycled economically.

Other endeavors attempting to address various cooling/heating applications and using Phase Change Material (PCM) are, US20180290044, U.S. Pat. Nos. 6,584,798, 5,386,701, US20110022137, US20100223943, U.S. Ser. No. 10/481,021, U.S. Pat. Nos. 7,681,249, 5,201,365, 4,856,294, JP2017110324, CN108652095, CN105815847, U.S. Pat. No. 6,915,641B2, where none of which can provide long hours of untethered cooling/heating.

While each of these personal cooling and heating systems may fulfill their respective particular objectives and requirements, and are most likely quite functional for their intended purposes, it will be noticed that none of the prior art cited disclose an apparatus and/or method that is portable, provide long time mobile operation up to 7 hours, lightweight, and low-cost within buying capacity of an industrial worker. Also, the prior art cannot provide 7 hours of continuous operation at a rate of 50 watts of adjustable cooling per hour. Besides, none of the prior art have used Gallium alloy based, non-toxic, room-temperature liquid metal as primary coolant, where liquid metal fluid state is maintained during operation using electrolyte solutions and pumped through the tubing to extract heat from the wearer.

A personal cooling system is configured to remove heat from a human user. The personal cooling system uses non-toxic Gallium alloy room-temperature liquid metal as primary coolant and PCM as secondary coolant. The system has a case with a pump having a pump suction and a pump discharge, the pump discharge is joined to a thermal conducting tubing. The tubing coil are is surrounded by a cooling medium (phase change material) within the case. A garment further has garment tubing having a garment tubing inlet and a garment tubing outlet. The garment tubing inlet is joined to the tubing cooling coil with a first tube in an umbilical tube assembly. A second tube in the umbilical tube assembly connecting the garment tubing outlet to the pump inlet. While in operation, the Gallium alloy liquid metal (mixed with 10% 1M NaOH) is pumped in the PCM cold storage where the high thermal conductive liquid metal gets cold very quickly and pumped into the vest tubing. While pumped into the vest tubing using a low-power DC pump the cold liquid metal absorbs body heat. After absorbing the body heat, the warm liquid metal is cooled by passing it again through the network of tubing embedded in cold phase-change material in the cold case, and the cooling cycle continues. The cold case is insulated from the external environment, allowing heat absorption from only the warm liquid metal. The heating cycle works in the same way except the case carries an integrated 110V ac-heater and different PCM in the storage case. A motor controller is electrically coupled to the pump which provides controlled cooling/heating by adjusting the liquid metal flow into the vest. A thermocouple is operatively coupled to the garment tubing and communicatively coupled to the motor controller.

In view of the foregoing limitations inherent in the known types of personal cooling and heating systems now present in the prior art, the present invention provides an apparatus that has been designed to provide the following features for a user:

- Minimum of 50 Watts of adjustable cooling per hour for 7 hours, totaling 350 Watts cooling at 95° F.
- Maximum system weight of 9.25 pounds including vest, primary coolant, secondary coolant, DC pump, accessories, and battery power source.
- Minimum of seven hours of continuous operation.
- Low powered (9 Ampere Hour [A·h] DC rechargeable battery can run the system for 12 hours)
- Use highly thermally conductive (~28 times higher than water) non-toxic Gallium alloy, room-temperature liquid metal as primary coolant, and Phase Change Material (PCM) as secondary coolant. Provide On-demand cooling and heating.
- The cooling system can store the cooling energy for on-demand use anytime within 48 hours. The user can carry the system in ambient temperature without losing the cooling energy, and use it anytime within 48 hours without refill.
- Low-cost (Unit price is a couple of hundred compared to the existing active untethered personal cooling system price $1,200-$10,000).
- The cooling storage is not affected by the ambient temperature, and the cooling performance is least affected by the ambient environment.
- Self-powered, and Easy to maintain with a minimum of hand tools.
- The primary coolant is fully reusable and recyclable with little to no effort.

These features are improvements which are patently distinct over similar devices and methods which may already be patented or commercially available. Especially, the novel and new methods of using liquid metal primary coolant eliminated the use of compressor and condenser-based cooling cycle (in prior arts), reducing the weight and power consumption of the system and increased the cooling performance along with the cooling/heating efficiencies. As such, the general purpose of the present invention, which will be described subsequently in greater detail, is to provide a field designed apparatus and method of use that incorporates the present invention. To attain this the present invention generally comprises four main components: 1) The PCM storage and cooling unit or the PCM storage and heating unit; 3) the Power Supply (PS); and 4) the Vest.

An additional object and advantage of the present invention is that unlike the prior art personal cooling and heating systems the present invention provides a fully user adjustable cooling and heating system that do not use the conventional high powered refrigeration cycle or compressor-condenser cooling cycle. Instead, the invention uses simple conduction-based cooling cycle removing the limitation of high-power consumption of the prior art personal cooling systems. The controls are easy to use and the unit is durable for use in the industrial and field settings.

These together with other objects of the invention, along with the various features of novelty which characterize the invention, will be pointed out with particularity in the claims. For a better understanding of the invention, its operating advantages and the specific objects attained by its uses, reference has been made to the accompanying drawings and descriptive matter in which there is illustrated preferred embodiments of the invention.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
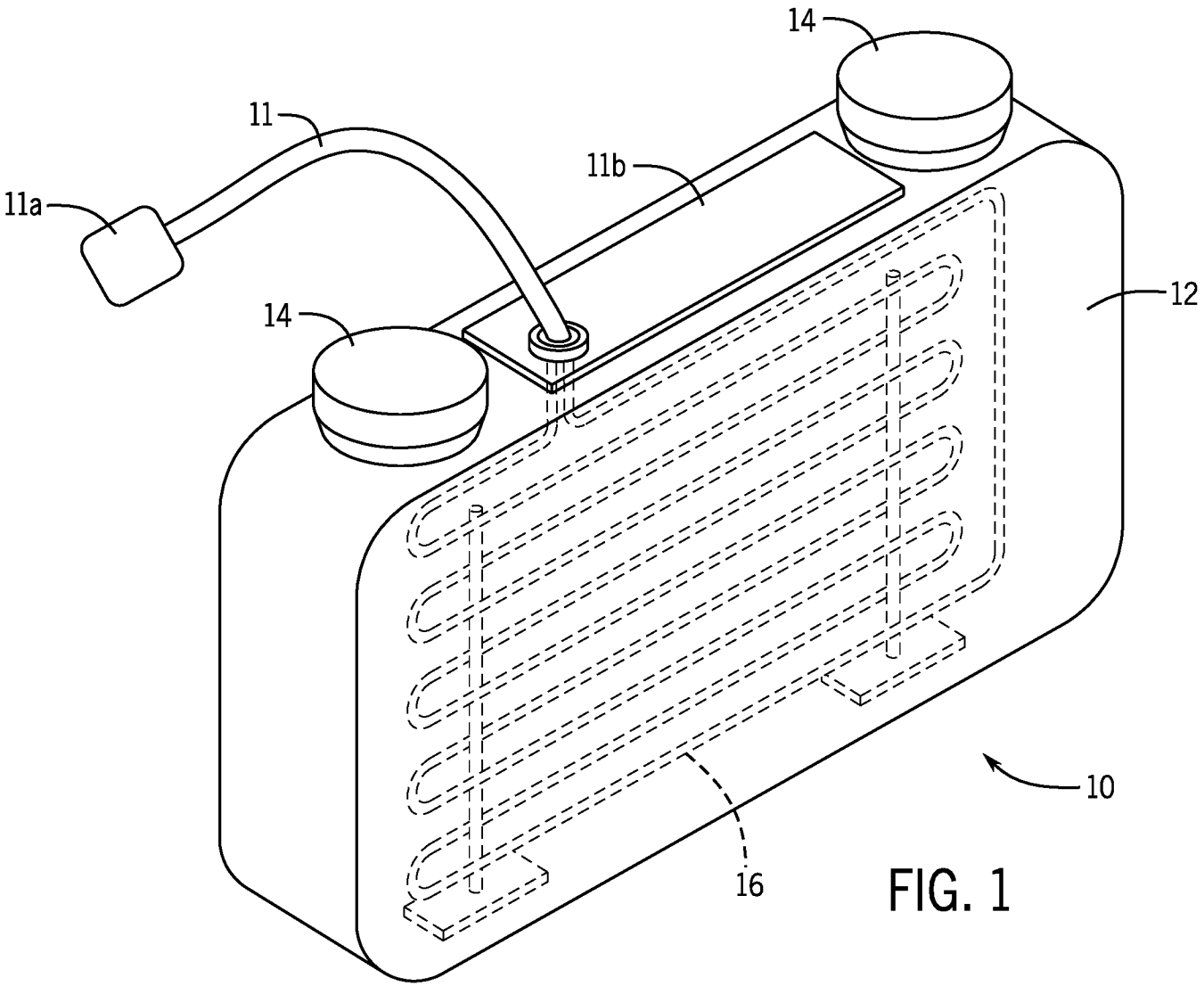
FIG. 1 shows a front perspective view of one embodiment of the present invention.

By way of example, and referring to FIGS. 1-5, one embodiment of a personal cooling system further comprises a hybrid liquid metal personal cooler 10. The hybrid liquid metal personal cooler 10 is joined to an umbilical tube 11 having an umbilical tube connector 11*a* through a thermally insulated maintenance access cover 1 lb.

The hybrid liquid metal personal cooler 10 further comprises a stainless-steel double-walled vacuum-insulated case 12, attached to the umbilical tube connector 11*a*, a first insulating cap 14 and a second insulating cap 16. The umbilical tube 11 is joined to a cooling coil 16 which is used to cool a dynamic fluid in the cooling coil 16 in a cooling mode of operation.

In some embodiments, the stainless-steel double-walled vacuum-insulated case 12 further comprises a phase change material 18. A heater coil 18 is now joined to an alternating current connector 18*b* such that comprises a stainless-steel double-walled vacuum-insulated case 12 now has a warming mode of operation.

Embodiments of the disclosed invention can be used in clothing. For instance, vest 20 further comprises a vest front 20*a* joined to a vest rear 20*b*. The vest 20 is joined to a vest umbilical tube 21 having a vest umbilical tube connector 21*a*. In some embodiments the vest front 20*a* has a zipper 22.

In some embodiments, the vest can have vest tubing 24 which carries a dynamic fluid through the vest 20. The vest tubing 24 is connected to the vest umbilical tube 21 with an outlet divider and an inlet divider 26.

Figure 5:
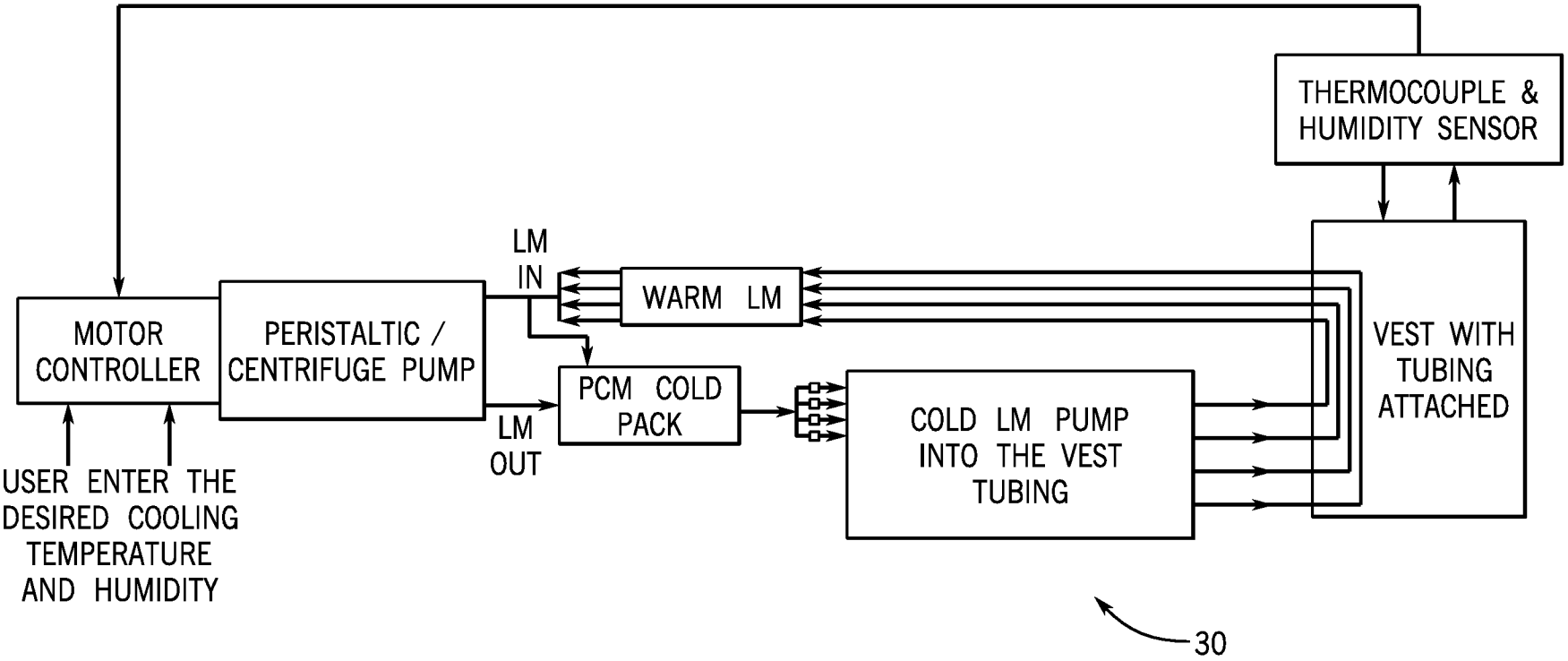
FIG. 5 shows a schematic view of one embodiment of the present invention.

Turning to FIG. 5, the hybrid liquid metal personal cooler 10 further comprises a closed loop heat exchanger 30 as follows. A motor controller is electrically coupled to a pump. In some embodiments, the pump can be a peristaltic pump or centrifugal pump. The dynamic fluid exits the pump and then travels to a phase change material (PCM) creating a cool dynamic fluid. The cool dynamic fluid exits the heat exchanger 30 and travels to the vest 20 through the umbilical tubing as described above. This heats the cool dynamic fluid as heat is transferred from the user to the dynamic fluid creating a warm dynamic fluid. The warm dynamic fluid then travels into the pump intake.

In some embodiments, a thermocouple is attached to the vest 20 in order to monitor the temperature of the user, the dynamic fluid or both. This temperature can be used to adjust the motor controller in order to control the temperature of the user. In some embodiments, the user enters a desired temperature and then the vest 20 is measured for that temperature at intervals controlled by a timer. The motor controller then adjusts a flow rate to calibrate the measured temperature to the desired temperature.

EXAMPLE

In one example, the liquid-metal personal cooling system (PCS) can use Gallium alloy liquid-metal as the cooling medium. Liquid metal has a high thermal conductivity of 16.5 W/m·K, which is 28 times higher than water. The high thermal conductivity of liquid metal is leveraged to develop an active PCS which combines the mobility of passive cooling with the long duration and controlled performance of active cooling. Here, cold liquid metal is pumped through tubing (3⁄32" inner diameter, 5⁄32" outer diameter, Tygon) in the interior of the garment. The liquid metal absorbs body heat and flows through a network of tubing submerged in a PCM cold pack. The warm liquid metal quickly cools in the PCM cold pack (a stainless-steel double-layer vacuum container) and recirculates. Unlike most commercial passive PCS, the PCM cold pack is isolated from the external environment using a thermally isolated container.

The PCM container works as the cold pack for the hybrid cooling shirt. Circulating liquid metal cools down while passing through the cold pack. The container is designed to be manufactured using double-wall vacuum insulated stainless steel (1Cr18Ni9), which has corrosion resistance, high surface strength, and strong resistance to scouring in the presence of the liquid metal. Also, 1Cr18Ni9 stainless steel has a relatively low thermal conductivity, which is suitable for heat insulation of PCM. In addition, it is rust-resistant and does not react with PCM material. The PCM container has been designed in a rectangular shape for ease of carrying in a waist pouch bag. It has two thermal insulating caps giving access to its contents. These caps should be unscrewed when the cold pack is refilled or the PCM is cooled in a freezer. The PCM container has a double-wall vacuum-insulated detachable cover for liquid metal tube insertion and maintenance. A robust umbilical cord connects the container to the pump module and the cooling shirt. The dimensions of the container are designed to hold 4.2 lbs. of PCM designed to provide over 8 hours of cooling. Also, the PCM container increases the cooling efficiency of the PCM by 40% compared to passive PCS which uses PCM packs for cooling.

Experiment

The cooling performance of the active liquid-metal PCS along with a market-leading PCM passive cooling vest was tested and compared in the laboratory. The PCM cooling shirt was purchased from the Amazon. The experiment was carried out at 95° F. room temperature. First, a male-form mannequin was wrapped with PVC film (thermal conductivity of 0.19 W/m·k) to raise the thermal conductivity of its surface to resemble human skin more closely. Second, the mannequin was dressed in either the liquid-metal PCS or the PCM cooling vest. Next, when the cooling systems were in operation, the surface temperature of the mannequin was measured until the temperature rose to 86° F. Both the liquid metal cooling shirt and PCM cooling vests used 4 lb. of PCM for cooling.

Result

The liquid-metal PCS was able to maintain cooling 40% longer than the commercial PCM cooling vest. During the experiment explained above the mannequin surface was cooled to a minimum of 70° F. The maximum measured temperature on the mannequin surface throughout 7 hours of operation was 86° F. The room temperature was 95° F., and the average mannequin surface temperature was 76.1° F. throughout the experiment. Thus, the liquid metal cooling system achieved an average difference between room temperature and the mannequin surface at 18.9° F. The average temperature of the cold liquid metal coming out from the PCM cold pack was 67.4° F., and the average temperature of liquid metal going into the PCM cold pack after cooling the mannequin was 82.6° F. The liquid-metal PCS prototype was able to provide an average of 50.27 watts of cooling for 7 hours with fully loaded weight only 9.25 lb.

Figure 2:
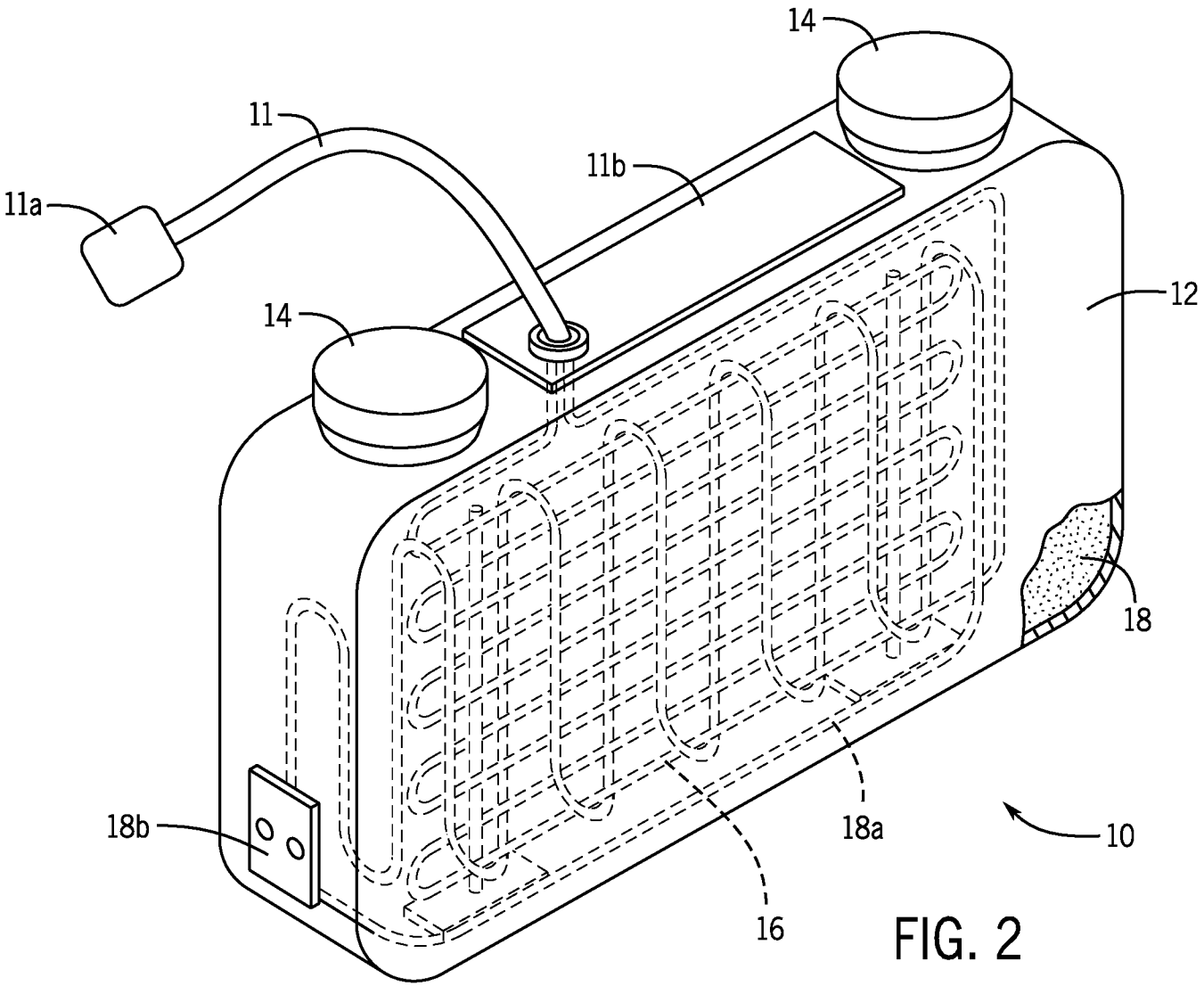
FIG. 2 shows a front perspective view of one embodiment of the present invention.
Figure 4:
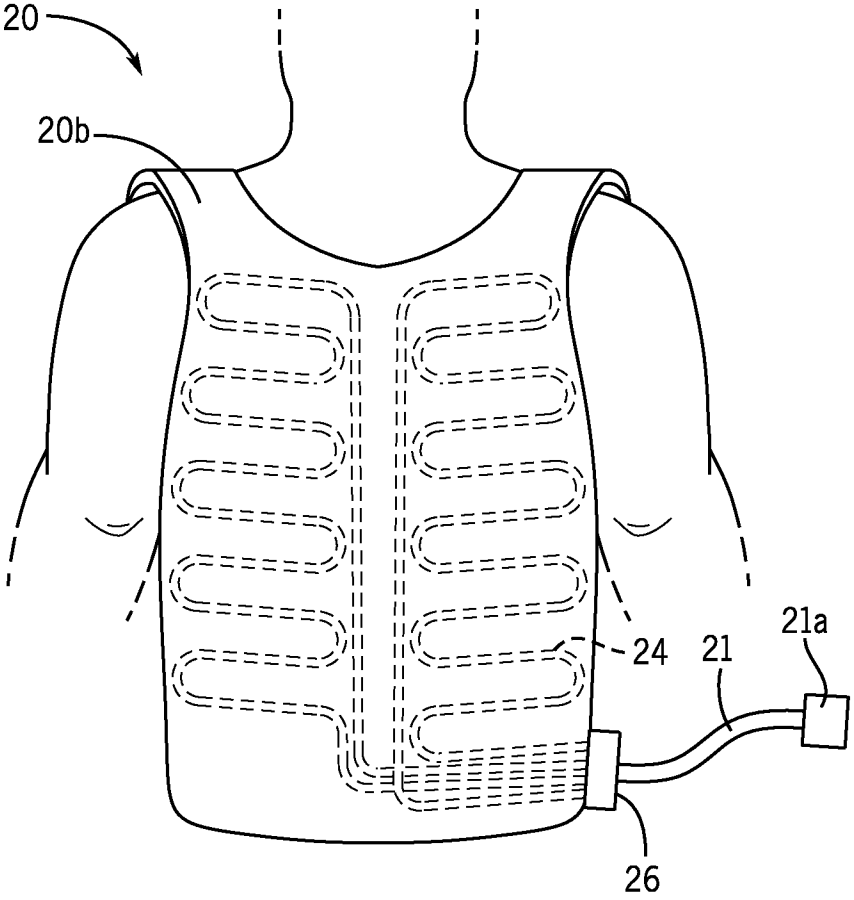
FIG. 4 shows a front perspective view of one embodiment of the present invention.
Figure 3:
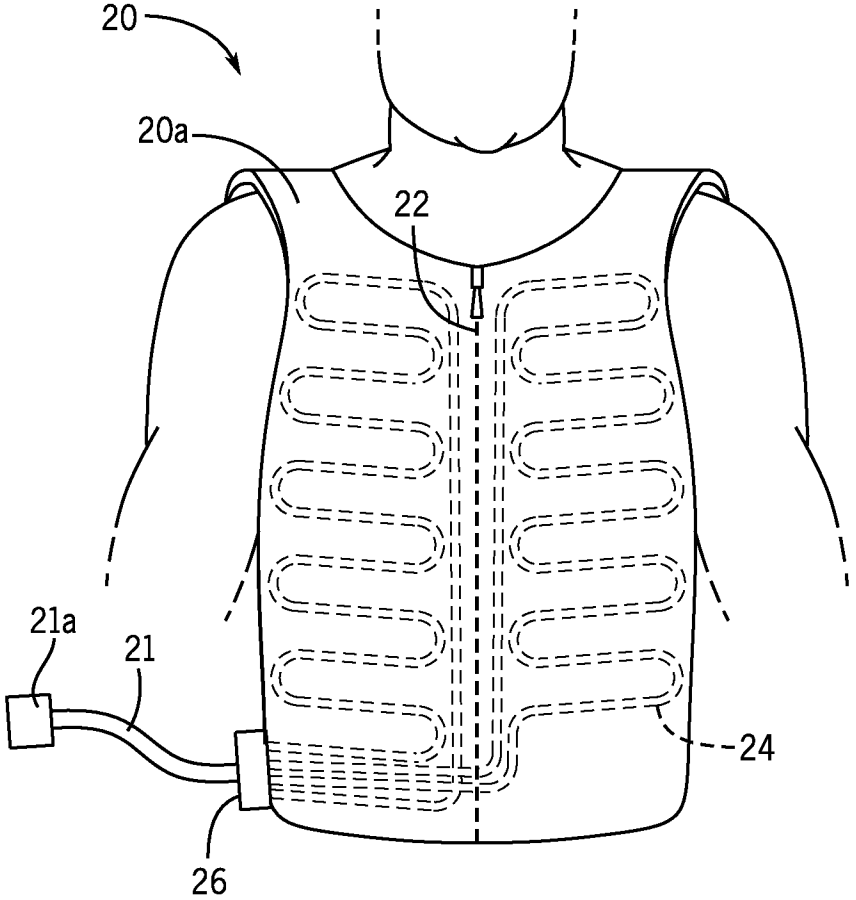
FIG. 3 shows a front elevation view of one embodiment of the present invention shown in use.

For personal heating application, the same primary coolant (liquid metal in 10% 1M NaOH) has been used and different secondary heating fluid is use such as hot wax, phase change material, or molten salt (FIG. 2). Also, an integrated heating coil heats the secondary heating medium when connected to a 110-240 AC outlet. Once heated and charged, the thermos is disconnected from the AC outlet and ready for use with the garment. Besides the heating coil, a thermally conductive tube network is installed inside the thermos, which carries the liquid metal (primary heating medium). The liquid metal is pumped through the tubing, which absorbs heat from the hot wax, phase change material, or molten salt. Now, the warm liquid metal is pumped through the tubing integrated into a garment (vest and/or trouser). While passing through the garment, the warm liquid metal releases heat and warm up the body of the wearer. After releasing the heat, the cold liquid metal is heated by passing it through the network of tubing embedded in the heat storage (wax, phase change material, or molten salt) inside the thermos (FIG. 1). The cycle continues when the warming system is in operation. The secondary heating medium, which acts as thermal storage, is insulated from the external environment, allowing heat transfer to only the cold liquid metal. It follows that the use of the liquid metal is critical for obtaining superior cooling.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A hybrid personal cooling system, configured to remove heat from a human user; the personal cooling system comprising:

a case comprising a pump having a pump suction and a pump discharge, the pump discharge is joined to a cooling tubing coil; wherein the case is a stainless-steel double-walled vacuum-insulated case;

a pair of insulating caps, providing access to the case;

a phase change material, inserted into the case through the pair of insulating caps and surrounding the cooling tubing coil within the case;

a garment, comprising garment tubing having a garment tubing inlet and a garment tubing outlet; wherein the garment tubing inlet is joined to the cooling tubing coil with a first tube in an umbilical tube assembly;

a maintenance cover, attached to the case between the pair of insulating caps, and joined to the umbilical tube assembly with an umbilical tube connector;

a second tube in the umbilical tube assembly connecting the garment tubing outlet to the pump inlet;

a dynamic fluid, comprising an alloy room-temperature liquid metal, wherein the dynamic fluid fills the cooling tubing and the garment tubing;

a motor controller, electrically coupled to the pump;

a thermocouple, operatively coupled to the garment tubing and communicatively coupled to the motor controller;

wherein the motor controller is programmed with instructions to:

receive a desired cooling temperature and humidity from the human user;

while the pump is active execute the following loop of instructions;

receive an actual temperature from the thermocouple;

adjust a pump flow rate in the pump.

2. The personal cooling system of claim 1, wherein the liquid metal is a Gallium alloy of Gallium, Indium, and Tin.

3. The personal cooling system of claim 2, wherein the dynamic fluid further comprises approximately 90% by weight of the liquid metal and approximately 10% by weight one molar sodium hydroxide in order to reduce oxidation of the liquid metal.

4. The personal cooling system of claim 3, wherein the phase change material is at least one member of a phase change set consisting of: an organic phase change material selected from the organic phase change material set consisting of: paraffin and non-paraffin materials; an inorganic phase change material selected from the inorganic phase change material set consisting of: salt hydrate and metallic materials; and an Eutectic selected from the Eutectic set consisting of: organic-organic, inorganic-inorganic, organic-inorganic materials.

5. The personal cooling system of claim 4, wherein the dynamic fluid is formulated to release heat through conduction while passing through the cooling tubing coil surrounded by the phase change material while absorbing heat through conduction while passing through the second tube in order to remove heat from the human user.

6. A hybrid personal heating system, configured to add heat to a human user; the personal heating system comprising:

a case comprising a pump having a pump suction and a pump discharge, the pump discharge is joined to heating tubing; wherein the case is a stainless-steel double-walled vacuum-insulated case;

a pair of insulating caps, providing access to the case;

a heater coil, surrounded by a phase change material within the case; wherein the heating tubing travels through the phase change material creating a personal heating system;

an alternating current connector, electrically coupled to the heater coil;

a garment comprising garment tubing having a garment tubing inlet and a garment tubing outlet; wherein the garment tubing inlet is joined to the heating tubing with a first tube in an umbilical tube assembly;

a maintenance cover, attached to the case between the pair of insulating caps, and joined to the umbilical tube assembly with an umbilical tube connector;

a second tube in the umbilical tube assembly connecting the garment tubing outlet to the pump inlet;

a dynamic fluid, comprising an alloy room-temperature liquid metal, wherein the dynamic fluid fills the heating tubing and the garment tubing;

a motor controller, electrically coupled to the pump;

a thermocouple, operatively coupled to the garment tubing and communicatively coupled to the motor controller;

wherein the motor controller is programmed with instructions to:

receive a desired heating temperature and humidity from the human user;

while the pump is active execute the following loop of instructions;

receive an actual temperature from the thermocouple;

adjust a pump flow rate in the pump.

7. The hybrid personal heating system in claim 6, wherein the liquid metal is a Gallium alloy of Gallium, Indium, and Tin.

8. The hybrid personal heating system in claim 6 wherein the dynamic fluid further comprises approximately 90% by weight of the liquid metal and approximately 10% by weight one molar sodium hydroxide in order to reduce oxidation of the liquid metal.

9. The hybrid personal heating system of claim 6, wherein the phase change material is wax, or molten salt.

10. The hybrid personal heating system of claim 6, wherein the dynamic fluid is formulated to absorb heat through conduction while passing through the heating tubing surrounded by the phase change material while releasing heat through conduction while passing through the second tube in order to transfer heat to the human user.

* * * * *